US009642404B2

(12) United States Patent
Giles et al.

(10) Patent No.: US 9,642,404 B2
(45) Date of Patent: May 9, 2017

(54) PATIENT WARMING GOWN

(75) Inventors: Andrew J. Giles, Libertyville, IL (US); Francis A. Czajka, Libertyville, IL (US)

(73) Assignee: Medline Industries, Inc., Northfield, IL (US)

( * ) Notice: Subject to any disclaimer, the term of this patent is extended or adjusted under 35 U.S.C. 154(b) by 639 days.

(21) Appl. No.: 13/585,435

(22) Filed: Aug. 14, 2012

(65) Prior Publication Data

US 2012/0305541 A1 Dec. 6, 2012

Related U.S. Application Data

(63) Continuation-in-part of application No. 13/116,749, filed on May 26, 2011.

(51) Int. Cl.
*A61B 19/08* (2006.01)
*A41D 13/12* (2006.01)

(52) U.S. Cl.
CPC ..... *A41D 13/1245* (2013.01)

(58) Field of Classification Search
CPC ..... A61F 7/02; A61F 2007/0001; A61F 2007/0231; A61B 19/08; A61B 2019/085; A61B 19/10; A61B 2019/106; A61B 17/0293; A61B 17/3431; A61B 19/081; A61B 2019/086; A61B 19/087; H05B 2203/036; A41D 13/1245
USPC ..... D2/720, 860; 219/211, 212, 529; 607/2; 128/846, 849, 852, 869, 873, 874; 602/2
See application file for complete search history.

(56) References Cited

U.S. PATENT DOCUMENTS

| | | | | |
|---|---|---|---|---|
| 3,500,014 | A * | 3/1970 | Longo Santo | 219/211 |
| 4,284,680 | A | 8/1981 | Awano et al. | |
| 4,569,874 | A * | 2/1986 | Kuznetz | 428/109 |
| 4,622,253 | A | 11/1986 | Levy | |
| 4,765,323 | A | 8/1988 | Poettgen | |
| 4,945,924 | A | 8/1990 | Poettgen et al. | |
| 4,988,053 | A | 1/1991 | Choi | |
| 5,038,779 | A * | 8/1991 | Barry et al. | 607/108 |
| 5,125,238 | A | 6/1992 | Ragan et al. | |
| 5,780,367 | A | 7/1998 | Handwerker | |
| 6,331,695 | B1 | 12/2001 | West | |
| 6,440,159 | B1 | 8/2002 | Edwards et al. | |
| 6,610,928 | B2 | 8/2003 | Synder | |

(Continued)

FOREIGN PATENT DOCUMENTS

| | | |
|---|---|---|
| JP | 2004-168008 | 6/2004 |
| JP | 3136000 | 9/2007 |

OTHER PUBLICATIONS

Kamath, M G., et al., "Needle Punched Nonwovens", Publciation by M.G. Kamath, Atul Dahiya, Raghavendra R. Hedge; Updated publication Apr. 2004; From www.engr.utk.edu.

(Continued)

*Primary Examiner* — Ophelia A Hawthorne
(74) *Attorney, Agent, or Firm* — Philip H. Burrus, IV

(57) ABSTRACT

A gown (100) having a body-covering portion (101) and an outer layer (111) coupled to the body-covering portion, thereby defining a pocket (112), is provided. The outer layer can include a film layer (116) having a thermally reflective side (101) disposed facing the body-covering portion. In a patient warming system (600), a warming device (601) can be provided. The warming device can be placed in the pocket to warm a patient.

19 Claims, 11 Drawing Sheets

(56) References Cited

U.S. PATENT DOCUMENTS

| | | | | |
|---|---|---|---|---|
| 6,770,848 | B2 * | 8/2004 | Haas et al. | 219/212 |
| 7,837,721 | B2 * | 11/2010 | Augustine et al. | 607/96 |
| 7,931,682 | B2 * | 4/2011 | Albrecht et al. | 607/108 |
| 7,976,572 | B2 * | 7/2011 | Ziaimehr | 607/96 |
| 8,453,264 | B2 | 6/2013 | Mickle et al. | |
| 2004/0096620 | A1 | 5/2004 | Dillinger | |
| 2006/0101558 | A1 | 5/2006 | Coleman et al. | |
| 2006/0135019 | A1 | 6/2006 | Russell | |
| 2006/0178717 | A1 | 8/2006 | Harris et al. | |
| 2006/0253954 | A1 * | 11/2006 | Music | 2/115 |
| 2008/0203080 | A1 | 8/2008 | Fung | |
| 2009/0209155 | A1 | 8/2009 | Goulet | |
| 2009/0217440 | A1 | 9/2009 | Sutker | |
| 2010/0089897 | A1 | 4/2010 | Bart | |
| 2010/0263104 | A1 * | 10/2010 | Flannery | 2/69 |
| 2011/0108538 | A1 | 5/2011 | Gray | |
| 2011/0302690 | A1 | 12/2011 | Cox et al. | |

OTHER PUBLICATIONS

"*3M Product Information—Bair Hugger Therapy", Underbody Series Blankets*, Published 2011 by Arizant Healthcare Inc.; 4 pages.

"*Hot Dog Warming System"; Product catalogue*; Published 2012 by Augustine Temperature Management; 2 pages.

"*Koala Warming System" Product Brochure*; Published 2011 by NovaMed USA; 4 pages.

"Bair Paws + Gown"—Product Brochure; *3M*; Published 2012 by Arizant Healthcare Inc.

Jackson, Brandon L., "NonFinal OA", U.S. Appl. No. 13/116,749, filed May 26, 2011; Mailed Dec. 21, 2012.

Jackson, Brandon L., "Final OA", U.S. Appl. No. 13/116,749, filed May 26, 2011; Mailed Oct. 2, 2013,.

Yang, In Su "PCT Search Report and Written Opinion", PCT/US2013/053397; Filed Aug. 2, 2013; Mailed Nov. 15, 2013.

Sook, Cho Y., "International Search Report", PCT/US2012/032149; Filed Apr. 4, 2012; Mailed Oct. 30, 2012.

Jackson, Brandon Lee "Appeal Decision", U.S. Appl. No. 13/116,749, filed May 26, 2011; Mailed Nov. 30, 2016.

"Medline Catalog", Bair Hugger Full Body Blankets by Arizan; *Medline Catalog*; http://www.medline.com/catalog/catalog.jsp; Unknown Publication date but believed to be prior to present application filing date.

"Medline Catalog", Bair Paws Flex Warming Gowns by 3M Healthcare; *Medline Catalog*; http://www.medline.com/catalog/catalog.jsp; Unknown Publication date but believed to be prior to present application filing date.

"Medline Catalog", Bair Paws Patient Warming Gown kits by 3M Healthcare; *Medline Catalog*; http://www.medline.com/catalog/catalog.jsp; Unknown Publication date but believed to be prior to present application filing date.

"Medline Catalog", Blankets by Smiths Medical; *Medline Catalog*; http://www.medline.com/catalog/catalog.jsp; Unknown Publication date but believed to be prior to present application filing date.

"Medline Catalog", Delta Pediatric Overlays by Span America; *Medline Catalog*; http://www.medline.com/catalog/catalog.jsp; Unknown Publication date but believed to be prior to present application filing date.

"Medline Catalog", Disposable Hypothermia Blankets by Cincinnati Sub Zero; *Medline Catalog*; http://www.medline.com/catalog/catalog.jsp; Unknown Publication date but believed to be prior to present application filing date.

"Medline Catalog", FilteredFlo Warming Tube by Cincinnati Sub Zero; *Medline Catalog*; http://www.medline.com/catalog/catalog.jsp; Unknown Publication date but believed to be prior to present application filing date.

"Medline Catalog", Maxi-therm Blanket by Cincinnati Sub-zero; *Medline Catalog*; http://www.medline.com/catalog/catalog.jsp; Unknown Publication date but believed to be prior to present application filing date.

"Medline Catalog", Mistral-Air Forced Air Warming Blankets by Stryker; *Medline Catalog*; http://www.medline.com/catalog/catalog.jsp; Unknown Publication date but believed to be prior to present application filing date.

"Medline Catalog", Patient Warming System by Halyard Health; *Medline Catalog*; http://www.medline.com/catalog/catalog.jsp; Unknown Publication date but believed to be prior to present application filing date.

"Medline Catalog", Soft-Temp Heat Therapy Pads/Parts by Adroit Medical; *Medline Catalog*; http://www.medline.com/catalog/catalog.jsp; Unknown Publication date but believed to be prior to present application filing date.

"Medline Catalog", Warming Blankets by Covidien; *Medline Catalog*; http://www.medline.com/catalog/catalog.jsp; Unknown Publication date but believed to be prior to present application filing date.

Rodriquez, Kari K., "Notice of Allowance", U.S. Appl. No. 13/116,749, filed May 26, 2011; Mailed Feb. 27, 2017.

* cited by examiner

PATIENT WARMING GOWN

CROSS REFERENCE TO PRIOR APPLICATIONS

This application is a continuation-in-part of U.S. application Ser. No. 13/116,749, filed May 26, 2011, which is incorporated by reference for all purposes.

BACKGROUND

Technical Field

This invention relates generally to a garment, and more particularly to a medical garment.

Background Art

Patients undergoing medical procedures can experience difficulty maintaining a sufficient body temperature to promote healing. For example, during a medical procedure requiring anesthetization, a patient's core body temperature can drop up to 1.7 degrees centigrade due to anesthetization. During recovery, it can be advantageous to keep the patient warm. Benefits of patient warmth include a lower risk of infection after the procedure, faster healing, and lower incidents of excessive bleeding.

Keeping a recovering patient warm is not a trivial task. One cannot simply "turn up the thermostat" in the patient's room because doing so is inherently inefficient. Prior art devices designed for patient warming have been cumbersome and expensive. For example, U.S. Pat. No. 5,125,238 to Ragan et al. describes a disposable patient heating blanket where multiple layers form an air chamber. A complex series of blowers, heating devices, cooling devices, and so forth are then connected to the device. This complex network of machines then introduces conditioned air into the chamber. The problem with such devices, aside from cost and complexity, is that the necessary tubes, conduits, and machines are cumbersome to use and are noisy. Accordingly, the use of these systems can prevent a recovering patient from sleeping well, which can inhibit the recovery process.

It would be advantageous to have a more effective and lower cost patient warming device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
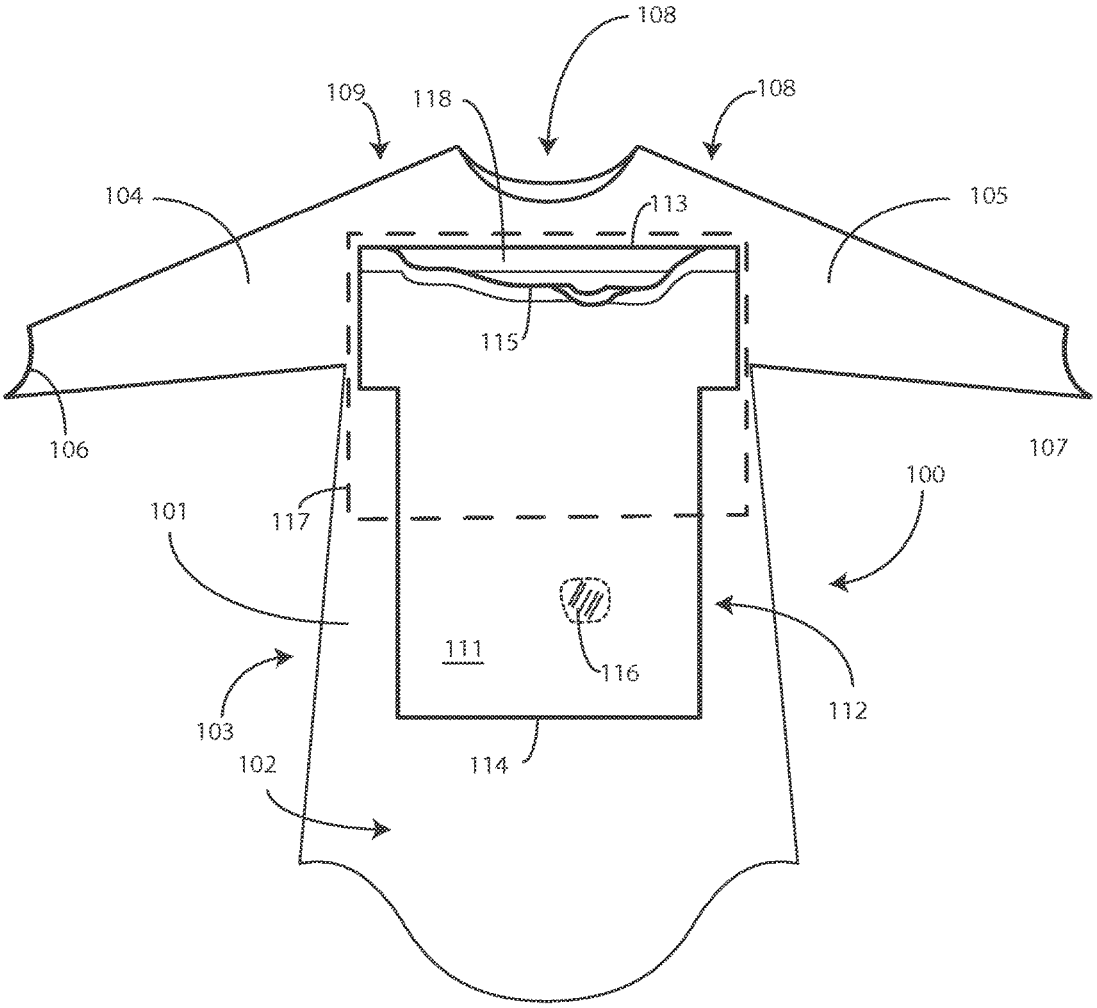
FIG. 1 illustrates one embodiment of a gown configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention provide a gown, which may be reusable in some embodiments and disposable in other embodiments, that includes a pocket configured to receive a reusable, battery-powered heating device. The pocket, in one embodiment, includes a reflective interior layer that forms a reflective pouch that is configured to reflect heat from the heating device toward the patient. The "heated" patient gown can then be used to provide active warming for patients before and after surgery. Suitable applications for embodiments of the invention include usage in hospitals or ambulatory surgery environments where maintenance of patient normothermia is desired.

In one or more embodiments, a patient warming system includes a disposable gown having a reflective pouch and a reusable, battery-powered, patient-controlled heating element. The patient warming system can also include a battery charger to recharge the battery of the heating element. For some applications, the battery charger can be a multi-unit charger that is configured to charge the batteries of multiple heating devices simultaneously, thus allowing an enterprise user to maintain a supply of fully charged heating units for insertion into the reflective pouches of gowns, whether disposable or reusable. Where battery-powered heating devices are used, the use of battery power provides complete freedom of movement for the patient. Accordingly, the patient can be warmed while being transferred between rooms or while being transported on a stretcher. Embodiments of the invention are simpler, easier to use, and less expensive than prior art solutions where a patient must be tethered to a warm air blower which runs on alternating current from a wall outlet. Moreover, the direct radiant heating provided by the heating devices of embodiments of the present invention provide a more soothing and comfortable heating than does the blowing hot air in prior art designs. Embodiments of the invention allow the heating element to wrap around the lower back and kidney areas of the patient to warm more vascular portions of the patient for better comfort and heat transfer.

Some prior art patient warming systems employ heated cotton blankets instead of convection-type airflow. In these systems, the blankets are kept in an oven-type warmer and are provided to patients upon request. The blankets retain heat for only a short time and then have to be replaced. Further, each and every blanket must be laundered, folded, and re-heated. Embodiments of the present invention provide advantages over heated blanket systems in that embodiments of the present invention provide active heating from a battery-powered heating element, which is preferable over residual heat. With residual systems, as soon as the residual heat is gone, the blankets no longer provide optimal benefit to the patient and must therefore be replaced. This is very inefficient and requires manpower to shuttle the blankets. Additionally, embodiments of the present invention allow the patient to control the amount of heat received. This control is not possible in heated blanket solutions.

Turning now to FIG. 1, illustrated therein is one example of a gown 100 configured in accordance with one or more embodiments of the invention. A body-covering portion 101 of the gown 100 is configured to wrap about the torso of a wearer. The body-covering portion 101, in one embodiment, is manufactured from a single, unitary layer of non-woven fabric. Examples include spunlace, spunbond, and blends of polyester, polypropylene, and/or polyethelyne, as well as combinations thereof. Suppliers of such materials include Cardinal Health in Dublin, Ohio, Kimberly Clark in Neena, Wis., Molnycke Health Care in Newtown, Pa., E. I. du Pont de Nemours and Company of Wilmington, Del., First Quality Nonwovens in Great Neck, N.Y., Ahlstrom Corporation of Helsinki, Finland, and Precept Medical Products, Inc., in Arden, N.C. Other materials suitable for use in gowns 100 described herein will be obvious to those of ordinary skill in the art having the benefit of this disclosure. The non-woven fabric can be a disposable material, and optionally can include and water resistant lining that prevents the passage of fluids through the body-covering portion 101. In another embodiment, the gown 100 is configured to be reusable after an appropriate cleaning and sterilization process has been applied. Examples of materials suitable for reuse include cotton, polyester, and cotton-polyester blends. In one embodiment, the length of the gown 100 is configured to run from a wearer's shoulder to at least below their knee.

The body-covering portion 101 includes a front portion 102 and a rear portion 103. The front portion 102 is configured as a frontal body-covering portion in that it is configured to cover the frontal portion of some or all of a user's body, or in another embodiment the frontal portion of some or all of a user's torso, when the user is wearing the gown. The body-covering portion 101 further includes a rear portion 103 that is configured to cover at least a portion of a wearer's backside. In FIG. 1, the rear portion 103 has a substantially similar length with the front portion 102, although those of ordinary skill in the art having the benefit of this disclosure will find it obvious that other lengths can be used. For example, in one embodiment the front portion 102 will be longer than the rear portion 103, thereby covering more of the wearer's body in the front than the rear. In another embodiment, the front portion 102 will be shorter than the rear portion 103, thereby covering less of the wearer's body in the front than in the rear.

A first sleeve 104 and a second sleeve 105 can be included. Where so, the first sleeve 104 and second sleeve 105 extend distally from the body-covering portion 101. The optional first sleeve 104 and the second sleeve 105 are configured to receive wearer's arms when the gown 100 is donned. In the illustrated embodiment of FIG. 1, the first sleeve 104 and second sleeve 105 are illustrated as long sleeves, and terminate in a first cuff 106 and a second cuff 107, respectively. However, it will be clear to those of ordinary skill in the art having the benefit of disclosure that embodiments of the invention are not so limited. Gowns in accordance with embodiments of the invention may equally be configured with short sleeves or no sleeves has a particular application may warrant. Moreover, the sleeves, whether short or long, can in some embodiments have openings running along their lengths that are selectively closable with a hook and loop or other fastener. Such openings can be used to access the patient for monitoring and care.

Embodiments of the gown 100 can be manufactured in a variety of ways. For instance, in one embodiment the body-covering portion 101 is a single piece of material. In other embodiments, the body-covering portion 101, first sleeve 104, and second sleeve 105, as well as the outer layer 111 discussed below, are configured as separate sections that are stitched, ultrasonically sealed, or otherwise attached together. Where included, the sleeves 104,105 may be attached to the body-covering portion 101 by stitching, ultrasonic sealing, or other appropriate method of attachment.

In one embodiment, the body-covering portion 101 defines a head insertion aperture 108 through which a user may insert their head when donning the gown 100. In the illustrative embodiment of FIG. 1, the head insertion aperture 108 is disposed between the front portion 102 and the rear portion 103, and is surrounded by shoulder portions 109,110 of the body-covering portion 101. The perimeter of the head insertion aperture 108 can take a variety of shapes, and may comprise a closed shape or an open shape for easier donning.

In one embodiment, the body-covering portion 101 defines a rear opening (not shown in FIG. 1) that is configured as a slit up the rear portion 103 of the gown 100. The front portion 102 of the gown 100 is configured, in one embodiment, to be placed against the front of the torso of a wearer. The body-covering portion 101 then wraps around and terminates at the rear opening. The rear opening can be defined by a left side and a right side, and in one embodiment is configured as a slit that runs most of the length of the body-covering portion 101, up the back of the gown 100.

The rear opening can be used to assist in donning the gown 100. For instance, a user may open the rear opening and pass their head, shoulders, and/or torso portions through the rear opening when donning the gown 100. Said differently, the right side and left side of the rear opening can be configured to permit the wearer to don the gown 100 by wrapping the right side and left side of the rear opening about the wearer's torso. A rear opening closing device, such as a belt, one or more snaps, a hook and loop fastener, or an adhesive fastener can be included to keep the rear opening closed when the user is wearing the gown 100.

An outer layer 111 is coupled to the body-covering portion 101, thereby defining a pocket 112. The outer layer 111 can be coupled to the body-covering portion in any of a variety of ways, including stitching, gluing, thermal welding, or other methods.

The pocket 112 is configured to selectively receive a warming device, as will be shown in subsequent figures. In the illustrative embodiment of FIG. 1, the pocket 112 is T-shaped, with the top 113 of the T-shape being oriented towards the neck opening defined by the head insertion aperture 108. In one or more embodiments described herein, the bottom 114 of the pocket 112 is narrower than the top 113, wherein the opening 115 is, to allow for an easier insertion of a heating element into the opening 115. In the illustrative embodiment of FIG. 1, the side of the pocket 112 nearest the neck opening defined by the head insertion aperture 108 defines the pocket's opening 115. In such an embodiment, the opening 115 will be at the top of the pocket 112 when the person is standing, thereby allowing gravity to work to retain the heating element within the pocket 112.

In one or more embodiments, the pocket 112 also includes a closure 118. In the illustrative embodiment of FIG. 1, the closure 118 is disposed along the opening 113 and can be used to selectively close the pocket 112. For example, when a warming device is inserted into the pocket 112, the closure 118 can be closed to retain the warming device in the pocket 112 regardless of whether the wearer is upright, prone, or upside down. To remove the warming device, the user simply opens the closure 118. In one embodiment, the closure 118 comprises a hook and loop fastener. However, other closure devices can be used as well, including buttons, snaps, and zippers.

In one or more embodiments, the outer layer 111 comprises a film layer 116 having a thermally reflective side disposed facing the body-covering portion 101. When a heating device is inserted into the pocket 112, the inclusion of the thermally reflective side provides a surface that reflects heat back towards the wearer. In one or more embodiments, the body-covering portion 101 disposed between the wearer and the outer layer 111 is thermally conductive. For example, in one embodiment this portion of the body-covering portion 101 is manufactured from a non-woven material that transfers heat. Accordingly, heat reflected from the thermally reflective side of the film layer 116 passes through the body-covering portion 101 to the user.

In the illustrative embodiment of FIG. 1, the outer layer 111 is disposed on the front portion 102 of the gown 100 at a chest-covering portion 117 of the gown 100. Other embodiments will be obvious to those of ordinary skill in the art having the benefit of this disclosure. For example, the pocket 112 formed by the outer layer 111 could be disposed along the rear portion 103 of the gown 100, on one or both sleeves 104,105 of the gown 100, on the shoulder portions 109,110 of the gown 100, or in combinations of these. Additionally, multiple reflective pockets can be placed along the gown 100 as well.

Figure 2:
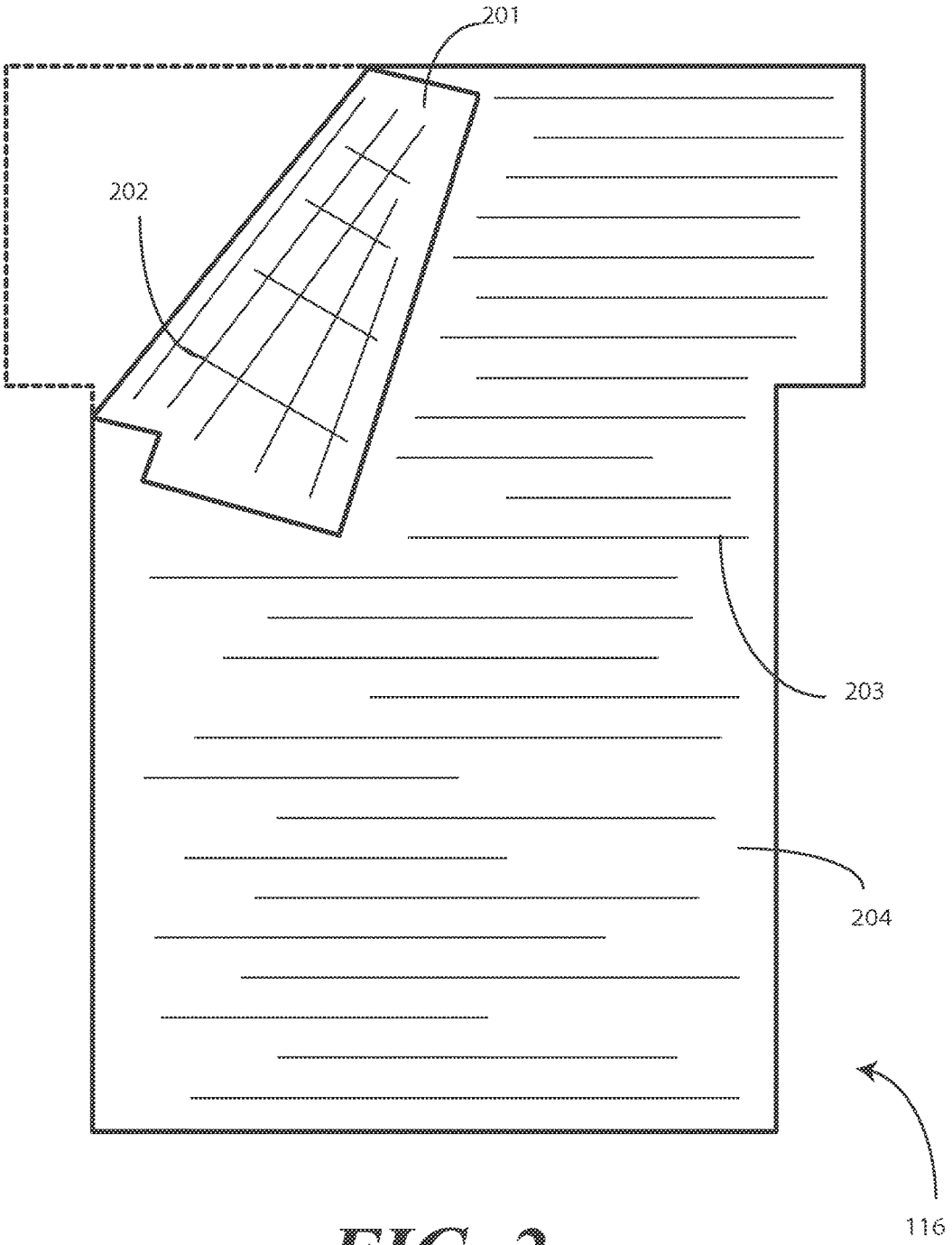
FIG. 2 illustrates one illustrative film layer suitable for use in pockets of gowns configured in accordance with one or more embodiments of the invention.
Figure 3:
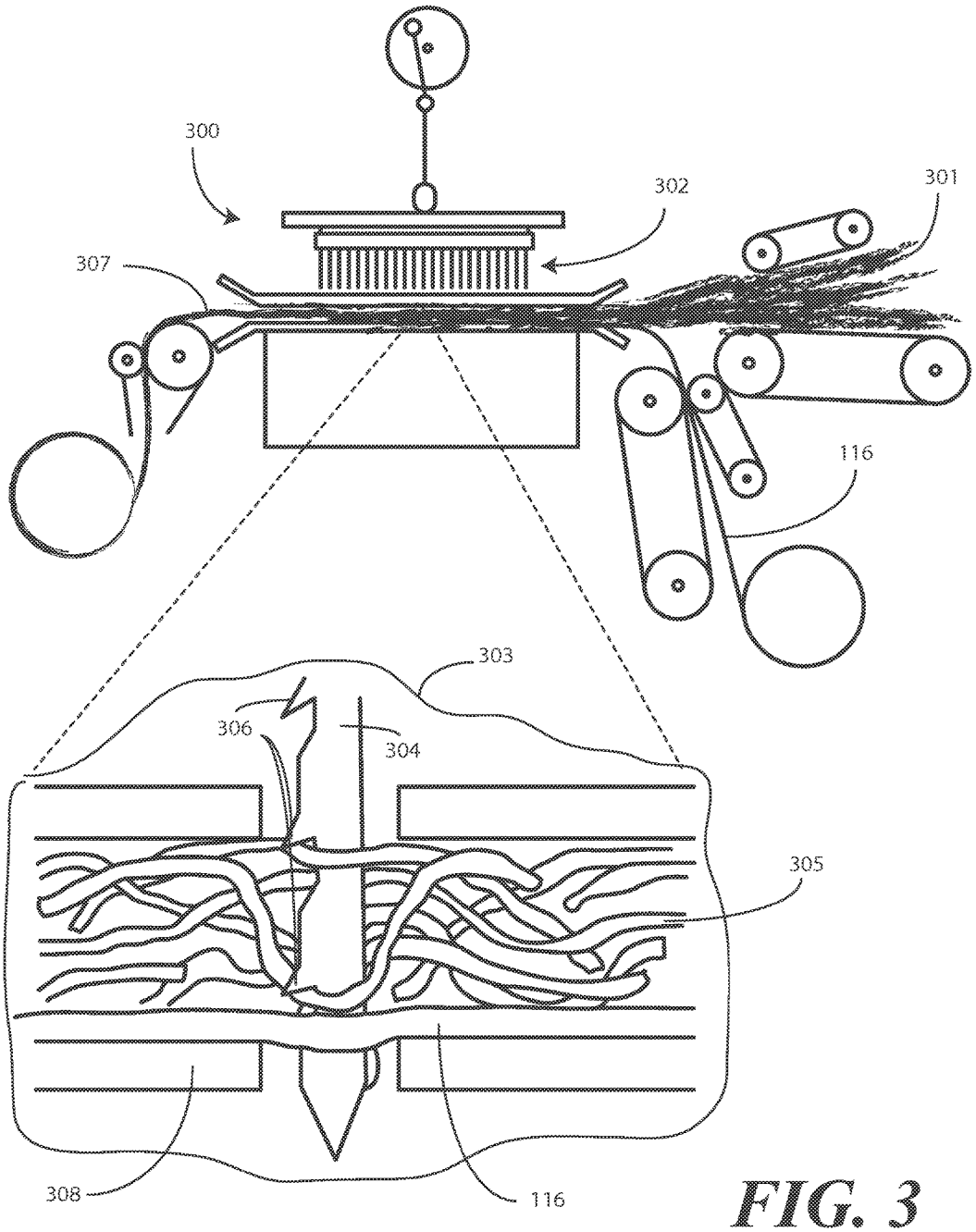
FIG. 3 illustrates one method of forming a pocket layer for a gown in accordance with one or more embodiments of the invention.
Figure 4:
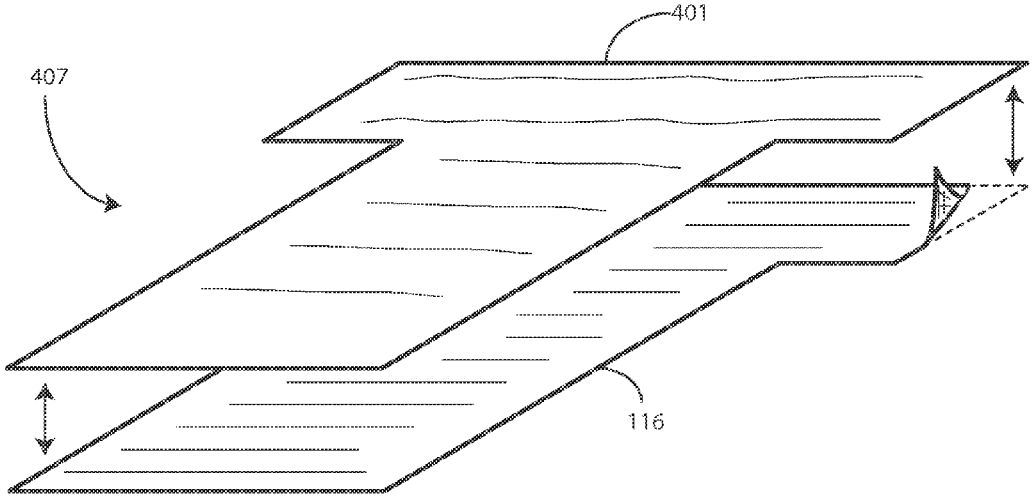
FIG. 4 illustrates another method of forming a pocket layer for a gown in accordance with one or more embodiments of the invention.

Turning now to FIGS. 2-4, illustrative methods for forming the outer layer (111) that defines the pocket (112) will be described. As noted above, in one embodiment, the outer layer (111) comprises a film layer 116 having a thermally reflective side facing toward the body-covering portion (101) of the gown (100). FIG. 2 illustrates one example of such a film layer 116. The film layer 116 of FIG. 2 is suitable for use both as the outer layer (111) and in some embodiments, as the body-covering portion (101). Note that where the film layer 116 is used as the body-covering portion (101), it can be omitted beneath the outer layer (111) to ensure that the body-covering portion (101) disposed beneath the pocket (112) is thermally conductive. Alternatively, as described below, the film layer 116 can be used for the entire body-covering portion (101) when the reflective material 202 is omitted beneath the pocket (112).

In one embodiment, the film layer 116 forms a core layer for the pocket (112) described above with reference to FIG. 1. In one embodiment, the film layer 116 is flexible and pliable enough to be incorporated into the outer layer (111) and or the body-covering portion (101) without significantly detracting from the feel, flexibility, and "drapability" of conventional gowns.

The film layer 116 can be manufactured from a variety of materials, including metalized materials or thermoplastic materials. Examples include polyethylene films, polypropylene films, polyester films, or polybutylene films. In one embodiment the film layer 116 comprises a sheet of polyester-type film. For example, in one embodiment the film layer 116 can be manufactured from polyethelyene terepthalate. Polyethelyene terepthalate, which is also known as PTE or PETE, is a thermoplastic polymer resin that can exist as an amorphous, substantially transparent film. One advantage associated with polyethelyene terepthalate is that it provides—in addition to thermal properties—moisture barrier properties as well.

Another advantage of such thermoplastic materials is that polyethelyene terepthalate can be aluminized as a film. In one or more embodiments, the film layer 116 includes at least one reflective side 201. Aluminizing polyethelyene terepthalate is one way of achieving a reflective side 201 along the film layer 116. In a metalizing process, a reflective metal, such as aluminum, can be evaporated along the film layer 116 to make one or both sides of the film layer 116 reflective. It will be clear to those of ordinary skill in the art having the benefit of this disclosure that other metals, such as gold or silver, can be substituted for the aluminum in the metalizing process.

In another embodiment, the film layer 116 can be manufactured from Mylar. Mylar is a trade name for biaxially oriented polyethelyene terepthalate film. Mylar is well suited for use as the film layer because it too can be metalized to form the reflective side 201. Further, both Mylar and generic polyethelyene terepthalate exhibit very high tensile strengths without disrupting the flexible feel of a drape or blanket into which they are integrated.

In one or more embodiments, such as when the film layer 116 is used for the body-covering portion (101), the reflective material 202 can be selectively applied to only portions of the film layer 116. For example, when only selective reflection of thermal heat is desired, the reflective material 202 can be applied along sub portions of the film layer 116. Further, the reflective material 202 can be applied in accordance with predefined patterns, such as those that pass about an outline of the pocket (112).

In one or more embodiments, a thermally absorptive coating 203 is disposed on the film layer 116 on a side 204 opposite the reflective side 201. The thermally absorptive coating 203 is configured to receive incident light and convert the received light to heat. The thermally absorptive coating 203 can be applied in a variety of ways. For example, in one embodiment the thermally absorptive coating can be vapor deposited along the film layer 116. In another embodiment, the thermally absorptive coating 203 can be printed, screened, or sputtered along the film layer 116. In another embodiment, the thermally absorptive coating 203 can be painted along the film layer 116. The thermally absorptive coating 203 can capture ambient light and deliver it to the patient to provide an auxiliary warming source that works in addition to the heating element that is placed within the pocket (112).

The materials used to form the thermally absorptive coating 203 can also vary. In one embodiment, for example, the thermally absorptive coating 203 can be a paint, which has a color configured to absorb at least a predetermined spectrum or color of light. In one embodiment where paint is used, the paint comprises an ultra flat matte black paint configured to absorb substantially the entire visible spectrum. In another embodiment, the paint can be configured to optimally absorb only a predefined spectrum of light, such as the ultraviolet spectrum.

In another embodiment, the thermally absorptive coating 203 can be a rubberized, plasticized, or polymerized coating. Such a coating can be configured, as was the case with the paint, to have a color or other characteristic that is configured to absorb all or a predefined spectrum of light. Other materials can be used as well, including materials comprising carbon black, dark metal or thermally conductive metal layer materials, or exotic materials such as a thin coating of multi-walled carbon nanotube materials. Such nanotube coatings are effective in that they can be configured to absorb as much as 99.5 percent of the light that hits them. However, such sophisticated materials are generally not required for most applications. In many instances, a matte, flat, black coating, be it paint, ink, plastic, metal, or lacquer, will significantly improve the performance of blankets and drapes configured in accordance with embodiments of the invention as compared to conventional blankets and drapes.

The shape of the film layer 116 can be configured in any of a number of ways. In the illustrative embodiment of FIG. 2, the film layer 116 is configured in a T-shape, which is suitable for forming the outer layer (111) of the pocket (112) shown in FIG. 1. In other embodiments, the film layer 116 can be cut to other shapes in accordance with a particular application or to cover any selected portion of a patient. As will be shown below in FIGS. 9 and 10, another suitable shape for a pocket is an inverted trapezoid or polygon.

In one embodiment, the outer layer (111) of a pocket (112) can be formed by way of a needle punching process. Turning now to FIG. 3, illustrated therein is one such process. As shown in FIG. 3, the film layer 116 is being fed into a needle punch machine 300. Simultaneously, a non-woven bunch of interlocking fibers 301 are fed into the needle punch machine 300. The non-woven bunch of interlocking fibers 301 can be fund from a spunbond or carded web.

A plurality of barbed felting needles 302 then pass through the web of fibers and through the film layer 116, thereby punching a hole in the film layer 116 and causing one or more fibers to remain "stuck" in the newly formed hole. Zoomed view 303 illustrates this process. Felting needle 304 is passing through the web 305 of interlocking fibers 301. The felting needle 304 is additionally punching through the film layer 116. One or more barbs 306 catch the fibers and cause them to pass through the hole with the felting needle 304. When the needle is withdrawn, the film layer 116 acts as a stripper plate and strips the fibers from the barbs 306. Accordingly, the fibers remain stuck within the formed hole. When this process is repeated many times, a series of fibers stuck in the holes form an isotropic batting that feels like the surface of an ordinary blanket. The result is an outer layer of material 307 that exits the needle punch machine 200. The outer layer of material 307 can be spooled and then cut as desired in accordance to form pocket outer layers as described above.

While the film layer 116 can extend across substantially the entire outer layer (111) of a pocket (112), it will be clear to those of ordinary skill in the art having the benefit of this disclosure that embodiments of the invention are not so limited. In one or more embodiments, the interlocking fibers 301 can extend beyond the film layer 116. This can allow the resulting outer layer to be more readily stitched to the body-covering portion (101). Where this occurs, a stripper plate 308 can be used to pull the interlocking fibers 301 from the barbs 306 to form portions of the outer layer of material 307 without the film layer 116 therein. These portions would be configured simply as needle-punched material in accordance with well-known needle punch processes.

The film layer 116 can be oriented with either the reflective side (201) or the opposite side (204) first receiving the felting needle 304. For example, in one embodiment, the opposite side (204), upon which the thermally absorptive coating 203 is deposited, is oriented down such that the felting needle 304 pushes the fibers distally through the thermally reflective side (201) to the thermally absorptive side. This configuration leaves more of the reflective side (201) exposed. As more reflective material is exposed, more of the patient's body heat will be reflected by the reflective side (201). In another embodiment, the reflective side (201) is oriented down such that the felting needle 204 pushes the fibers through to the reflective side (201). This configuration leaves more of the absorptive side exposed.

In another embodiment, an outer layer (111) for a pocket (112) can be formed by way of a lamination process. Turning now to FIG. 4, illustrated therein is one such process. Specifically, a film layer 116 having a thermally reflective side (201) and a thermally absorptive side (203) is laminated to a layer of non-woven fabric 401 to form an outer layer material layer 407.

As shown in FIG. 4, in one embodiment the layer of non-woven fabric 401 can be configured to be the same size and shape as the film layer 116. In other embodiments, such as those described below with reference to FIG. 6, the layer of non-woven fabric can be configured to cover an area greater than that spanned by the film layer 116. In this latter embodiment, the film layer 116 is only configured to cover portions of the outer layer material layer 407.

Examples of non-woven fabrics suitable for the non-woven fabric 401 of FIG. 4 are similar to those described above with reference to the body-covering portion (101) and include spunlace, spunbond, and blends of polyester, polypropylene, and/or polyethelyne, as well as combinations thereof. This list is illustrative only. Other materials suitable for use will be obvious to those of ordinary skill in the art having the benefit of this disclosure. The non-woven fabric 401 can be a disposable material, and optionally can include and water resistant lining that prevents the passage of fluids through the outer layer material layer 407. In other embodiments, the outer layer material layer 407 is configured to be reusable after an appropriate cleaning and sterilization process has been applied.

As with the outer layer of material (307) described above with reference to FIG. 3, the film layer 116 can be oriented with either the thermally reflective side (201) or the thermally absorptive side (203) oriented towards the non-woven fabric 401. In another embodiment, a layer of the non-woven fabric 401 can be disposed on both sides of the film layer 116.

The film layer 116 and non-woven fabric 401 can be laminated together in a variety of ways. In one embodiment, a simple adhesive can be applied to the film layer 116. The non-woven fabric 401 can be adhered to the adhesive. In another embodiment, where the thermally absorptive side (203) is oriented facing the non-woven fabric 401, the thermally absorptive coating (203) can be used as an adhesive to adhere the non-woven fabric 401 to the film layer 116. Other laminating techniques can be used as well, including hot melt laminating techniques, thermal laminating techniques, and so forth.

Figure 5:
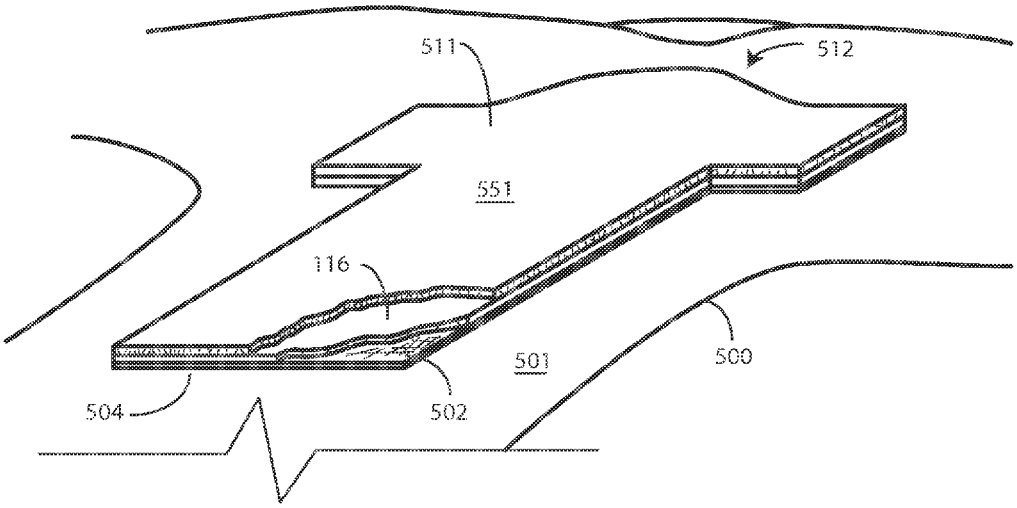
FIG. 5 illustrates a sectional view of a pocket layer on a gown configured in accordance with one or more embodiments of the invention.

Turning now to FIG. 5, illustrated therein is a sectional view of a gown 500 configured in accordance with one or more embodiments of the invention. The gown 500 includes an outer layer 511 that is attached to a body-covering portion 501 so as to form a pocket 512 for receiving a warming device. The outer layer 511 is shown sectionally so that each of the layers and components can be seen. As noted above, the outer layer 511 can be formed by a needle punch process as described with reference to FIG. 3 or by laminating a non-woven fabric (401) to the film layer 116.

As shown in FIG. 4, the film layer 116 forms the core of the outer layer 511. The film layer 116 is integrated with a fabric top layer 551, either by a needle punch process or laminating process as previously described. The film layer 116 has at least a thermally reflective side 504 in one embodiment, and can optionally have an opposite thermally absorptive side as described above (not shown in FIG. 5). In one embodiment, the thermally reflective side 504 is formed by depositing a thermally reflective layer of material 502 on the film layer 116. As previously described, the outer layer 511 can be cut, stitched, and sewn to the body-covering portion 501 to form the pocket 512.

Figure 6:
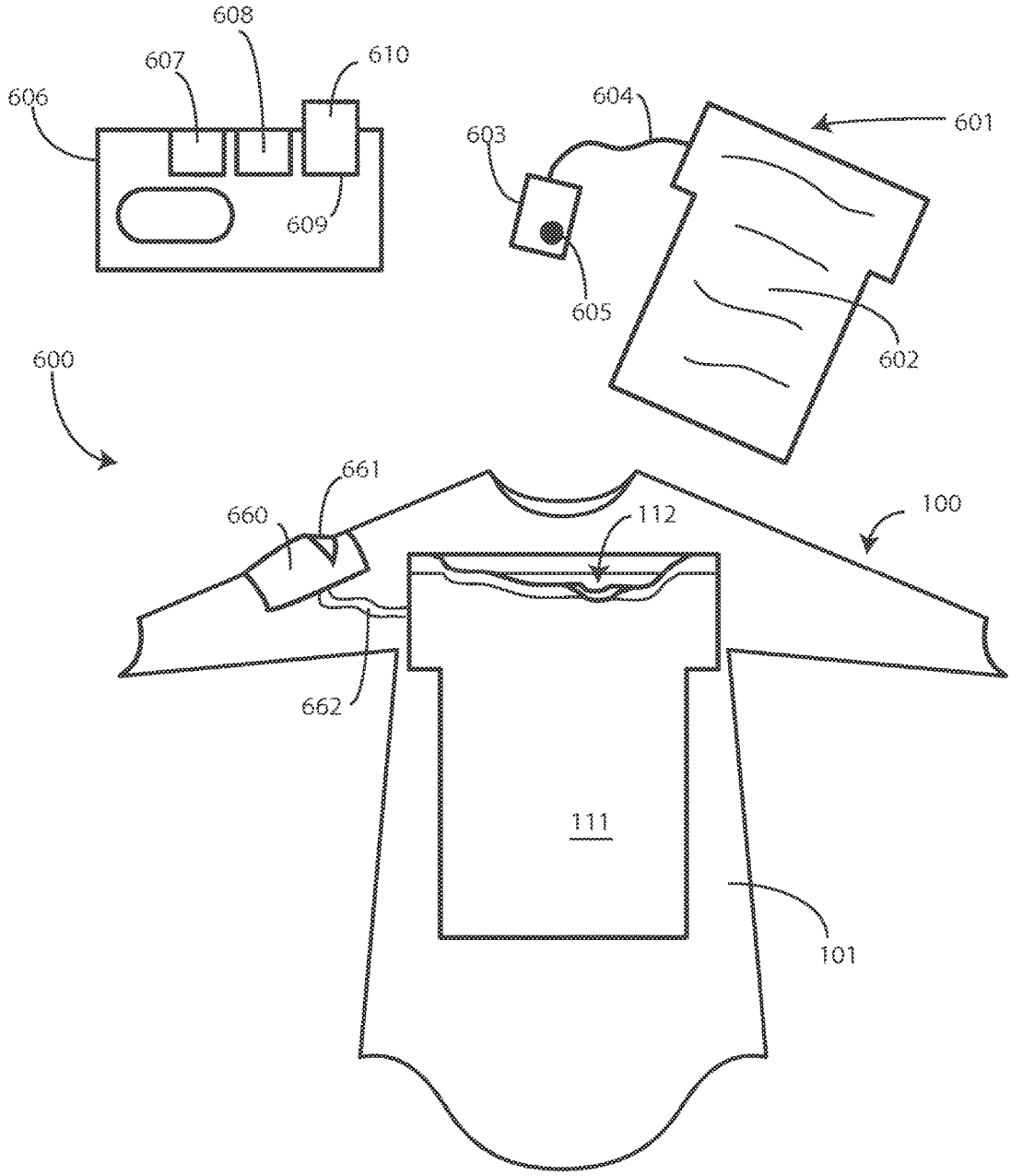
FIG. 6 illustrates one explanatory patient warming system configured in accordance with one or more embodiments of the invention.

Turning now to FIG. 6, illustrated therein is one embodiment of a patient warming system 600 configured in accordance with one or more embodiments of the invention. In the explanatory patient warming system 600 of FIG. 6, a gown 100 has a body-covering portion (101) and an outer layer 111 coupled to the body-covering portion 101, thereby defining a pocket 112.

The patient warming system 600 also includes a warming device 601, which is suitable for insertion into the pocket 112. Said differently, the pocket 112 of this patient warming system 600 is configured to receive the warming device 601 so that the warming device 601 can deliver heat to a patient wearing the gown 100. In one embodiment, either or both of the warming device 601 and/or the pocket 112 comprises a film layer having a thermally reflective side that can be disposed so as to face the body-covering portion 101 of the gown 100.

In this illustrative embodiment, the warming device 601 comprises a warming portion 602, a power supply 603, and a power cord 604 coupling the warming portion 602 to the power supply 603. In other embodiments, the power supply 603 and the warming portion 602 are integrated into a single device with a common cover that surrounds both the power supply 603 and the warming portion 602. One device suitable for use as the warming device 601 is the ARCtc™ Thermal Wrap manufactured by North American Rescue, LLC of South Carolina.

The warming portion 602 includes heating elements, while the power supply 603 has a battery-powered energy source configured to deliver energy to the heating elements. In one embodiment, the power supply 603 includes rechargeable batteries. Accordingly, the patient warming system 600 can also include a battery charger 606 for recharging the rechargeable batteries. To accommodate an enterprise user, such as a hospital or ambulatory surgery center, in one embodiment the battery charger 606 comprises a multi-unit charger having a plurality of pockets 607,608, 609 for receiving one or more rechargeable batteries 610 or power supply housings for recharging. Accordingly, a hospital can keep a supply of warming devices 601 fully charged for insertion into pockets 112 of gowns 100.

In this illustrative embodiment, the power supply 603 includes a control element 605. A user can adjust the control element 605 to adjust the amount of heat being delivered by the warming portion 602. In other embodiments, the control element 605 can be a stand-alone device, a remote control device, or integrated into the warming portion 602.

Since the power supply 603 is connected to the warming portion 602 by a power cord 604 in this embodiment, the gown 100 comprises a second pocket 660 configured to receive the power supply 603. The inclusion of a second pocket 660 allows the user to move around with the warming device 601 completely contained within the gown's compartments. There are thus no wires dangling around or dongles to hold, which makes patient movement easier. As with pocket 112, the second pocket 660 can define an opening 661 through which the power supply 603 can be inserted. The opening 661 can comprise a closure disposed at the opening 661 that is configured to selectively close the second pocket 660 so as to retain the power supply 603 therein. In one embodiment, this closure comprises a hook and loop fastener. An optional fabric channel 662 can be included to contain the power cord 604.

Turning now to FIGS. 7-10, illustrated therein are some additional pocket shapes that demonstrate the flexibility in patient warming afforded by embodiments of the prior invention. While the gown (100) of FIG. 1 included a pocket (112) only in the chest-covering portion (117), the embodiments of FIGS. 7-10 cover more areas of the patient's body.

Figure 7:
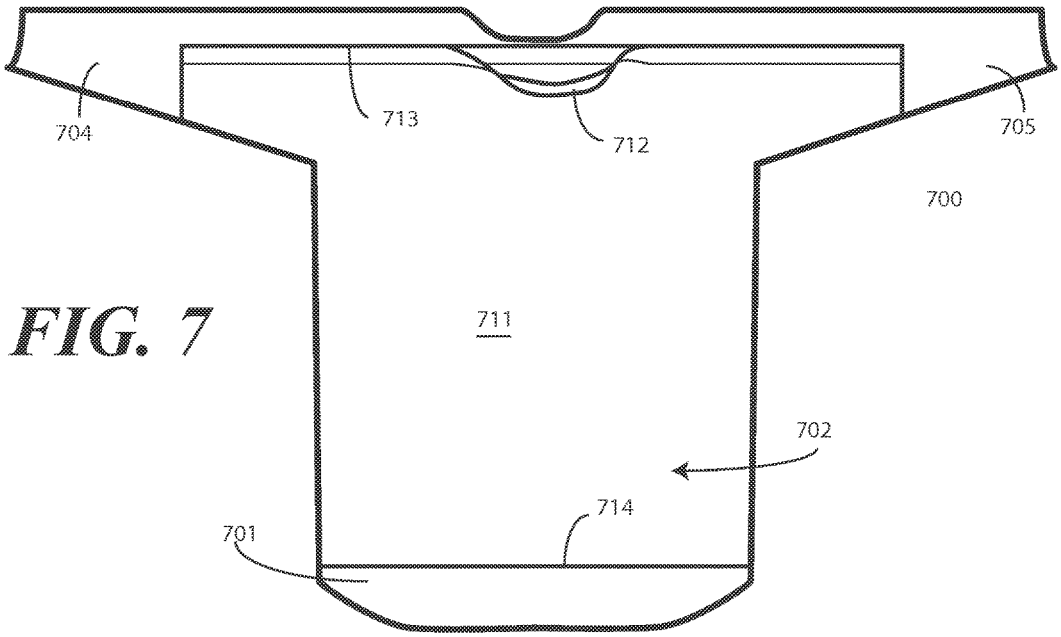
FIGS. 7 and 8 illustrate an alternate gown configured in accordance with one or more embodiments of the invention.
Figure 8:
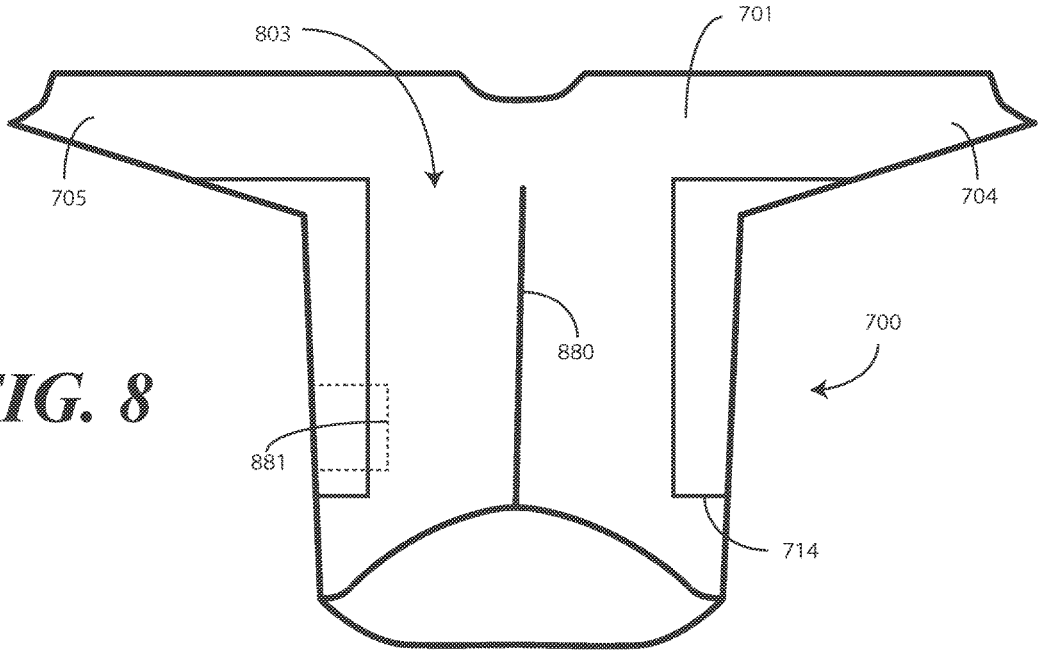

Beginning with FIGS. 7-8, illustrated therein is one example of a gown 700 configured in accordance with one or more embodiments of the invention. A body-covering portion 701 of the gown 700 is configured to wrap about the torso of a wearer. The body-covering portion 701 includes a front portion 702 and a rear portion 703. The front portion 702 is configured to cover the frontal portion of some or all of a user's body, while the rear portion 803 is configured to cover at least a portion of a wearer's backside.

A first sleeve 704 and a second sleeve 705 extend distally from the body-covering portion 701. The body-covering portion 701 defines a rear opening 880 that is configured as a slit up the rear portion 803 of the gown 700. When the front portion 802 of the gown 700 is placed against the front of the torso of a wearer, the body-covering portion 701 then wraps around and terminates at the rear opening 880. The rear opening 880 assists in donning the gown 700.

As with previous embodiments, an outer layer 711 is coupled to the body-covering portion 701, thereby defining a pocket 712. The pocket 712 is configured to selectively receive a warming device. In the illustrative embodiment of FIGS. 7-8, the pocket 712 is T-shaped, with the top of the T-shape being oriented towards the neck opening. Also as with previous embodiments, the bottom 714 of the pocket 712 is narrower than the top 713. However, in contrast to previous embodiments, the bottom 714 of the pocket 712 is sufficiently wide as to extend about the body-covering portion 701 and at least partially cover a kidney-covering portion 881 of the body-covering portion 701. This coverage results in increased therapeutic effects for some patients in that high circulation areas are covered by the warming device that is inserted into the pocket 712. This width also results in the top 713 of the pocket 712 extending across the first sleeve 704 and the second sleeve 705, respectively.

Figure 9:
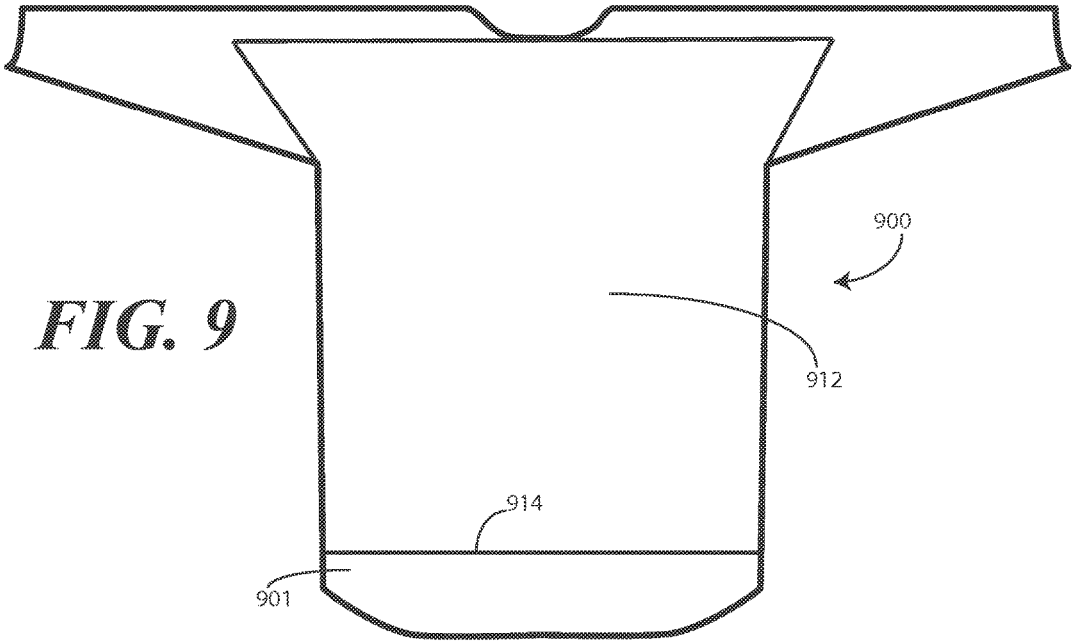
FIGS. 9 and 10 illustrate yet another alternate gown configured in accordance with one or more embodiments of the invention.
Figure 10:
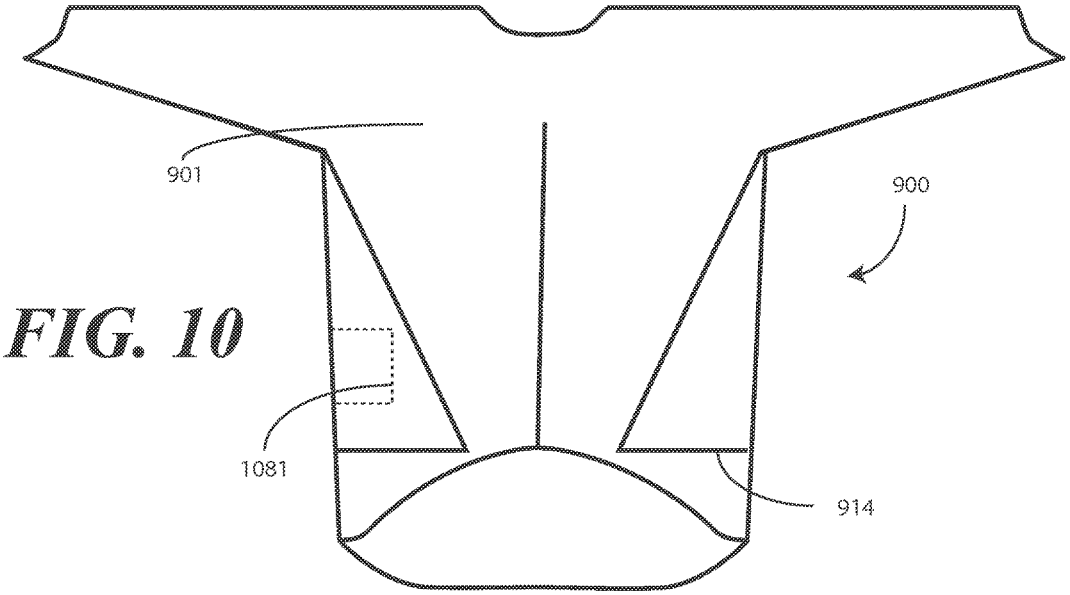

Turning now to FIGS. 9 and 10, illustrated therein is yet another gown 900 having a different shaped pocket 912. In FIGS. 9 and 10, rather than being T-shaped, the pocket 912 is configured in an inverse trapezoidal shape with a base 914 of the inverse trapezoid extending about the body covering portion 901 to at least partially cover a kidney covering portion 1081 of the body covering portion 901.

Figure 11:
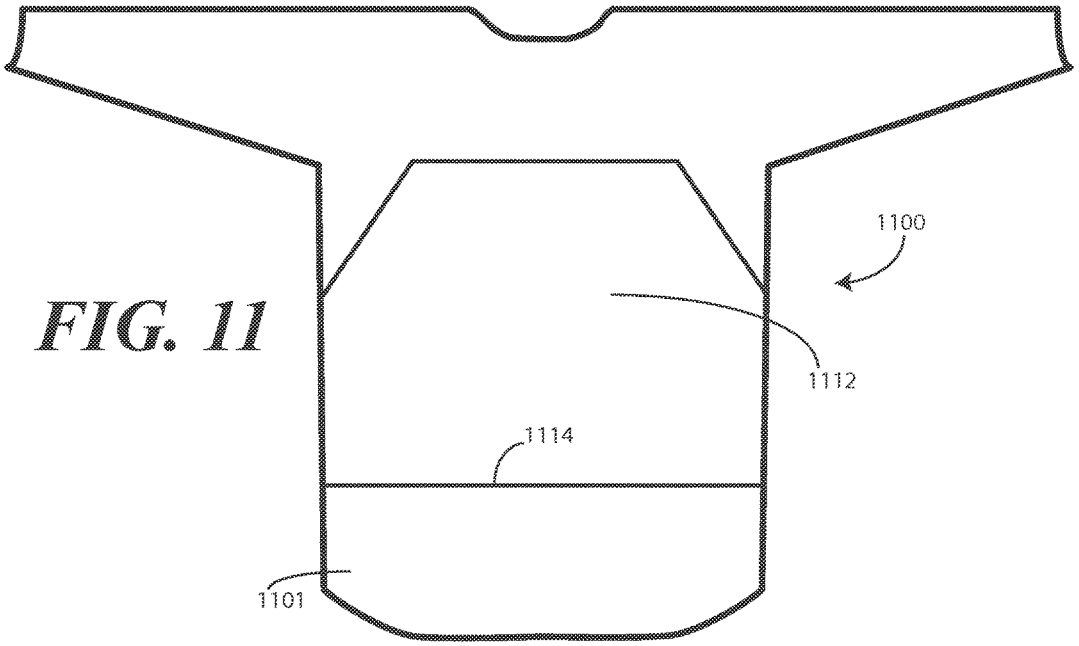
FIGS. 11 and 12 illustrate yet another alternate gown configured in accordance with one or more embodiments of the invention.
Figure 12:
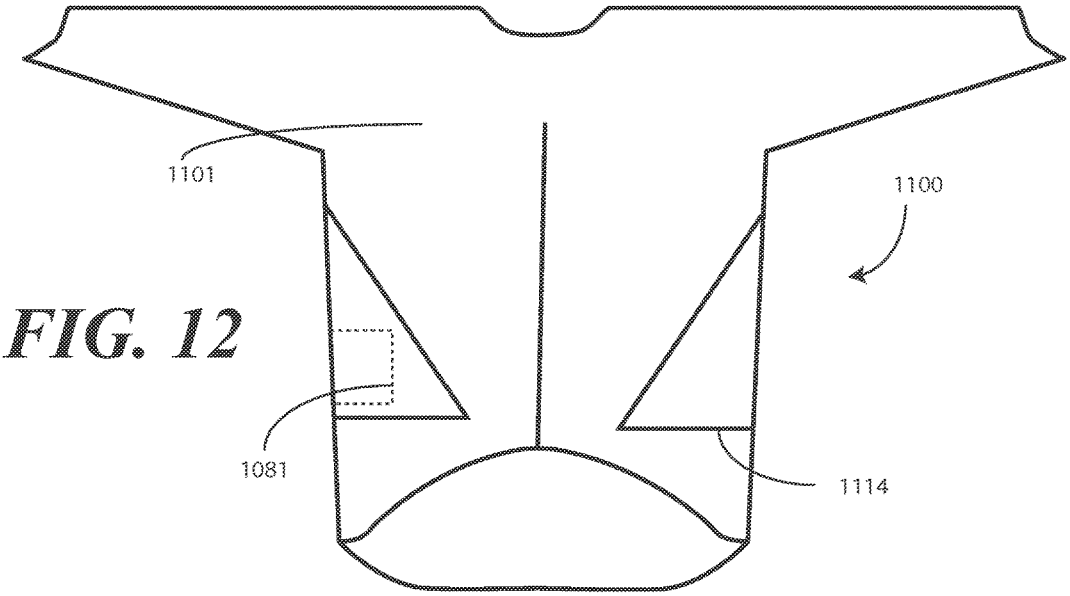

Turning now to FIGS. 11 and 12, illustrated therein is yet another gown 1100 having a different shaped pocket 1112. In FIGS. 11 and 12, rather than being T-shaped or inverse trapezoidal, the pocket 1112 is configured in an upright trapezoidal shape with a base 1114 of the upright trapezoid extending about the body covering portion 1101 to at least partially cover a kidney covering portion 1081 of the body covering portion 1101.

Figure 13:
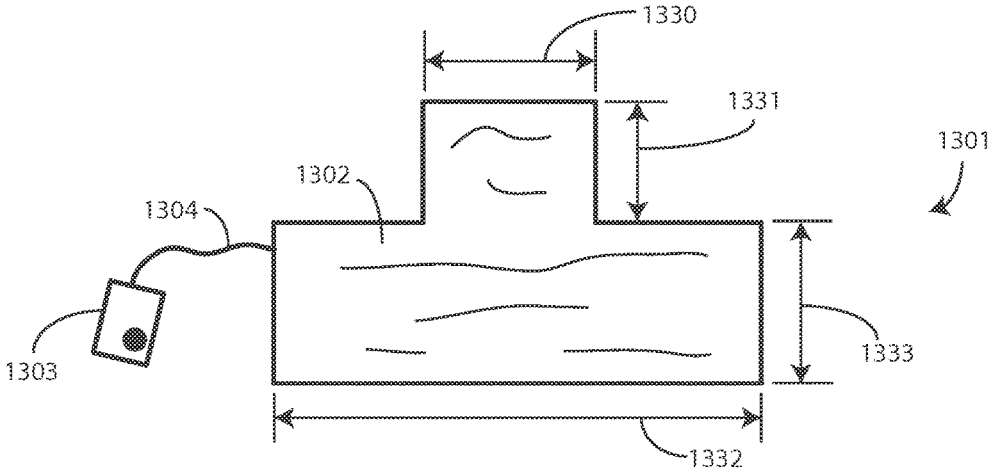
FIG. 13 illustrates another warming device configured in accordance with one or more embodiments of the invention.

Turning now to FIG. 13, illustrated therein is a warming device 1301 suitable for insertion into the pocket (1112) of FIGS. 11 and 12. The warming device 1301 comprises a warming portion 1302, a power supply 1303, and a power cord 1304 coupling the warming portion 1302 to the power supply 1303. In other embodiments, the power supply 1303 and the warming portion 1302 are integrated into a single device with a common cover that surrounds both the power supply 1303 and the warming portion 1302.

Figure 14:
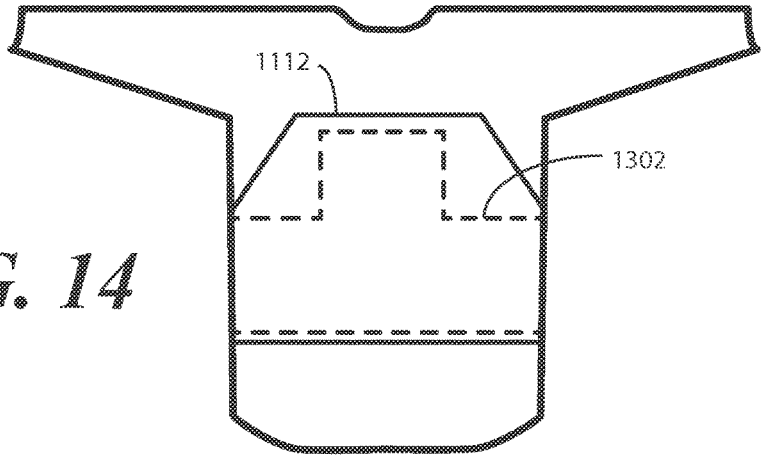
FIGS. 14 and 15 illustrate another warming system configured in accordance with one or more embodiments of the invention.
Figure 15:
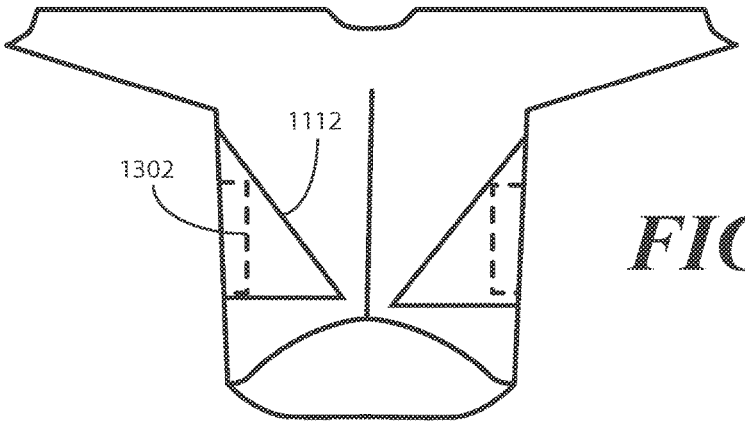

In this illustrative embodiment, the warming portion 1302 is configured as an inverse T. A width 1330 of the base of the inverse T, in this illustrative embodiment, is about nine inches. The height 1331 of the base of the inverse T, in this illustrative embodiment, is about six inches. The width 1332 of the top of the inverse T is about 30 inches in this embodiment, while the height 1333 of the top of the inverse T is about ten inches. As shown in FIGS. 14 and 15, the inverse T of the warming portion 1302 fits nicely within a pocket 1112 having an upright trapezoidal shape.

Figure 16:
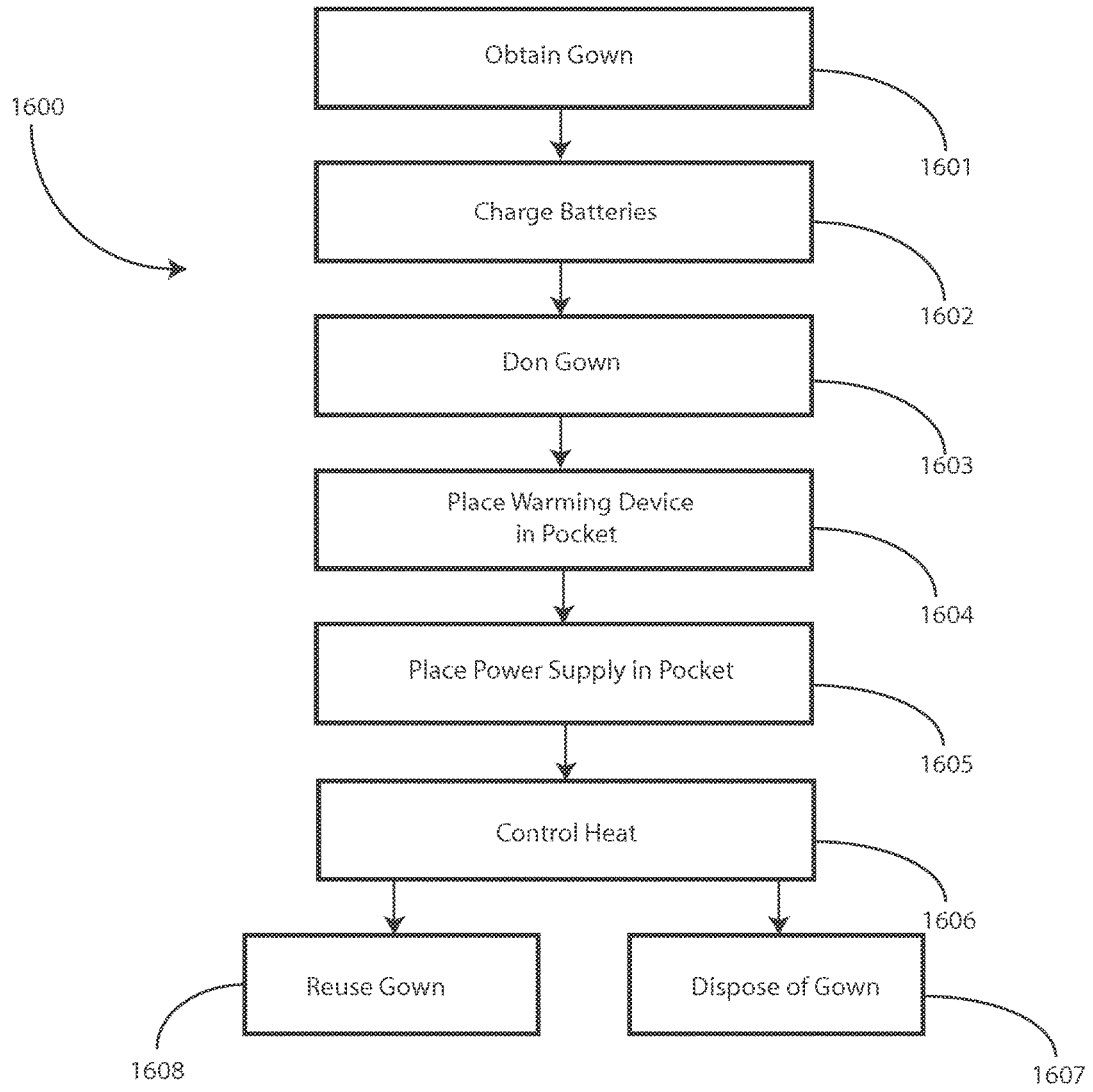
FIG. 16 illustrates one explanatory method of using a gown configured in accordance with one or more embodiments of the invention.

Turning now to FIG. 16, illustrated therein is a flow chart depicting a method 1600 of warming a patient in accordance with one or more embodiments of the invention. It should be understood that the method 1600 of FIG. 16 is illustrative only, as other methods could be used as well. Further, most of the steps shown in FIG. 16 have been described above, so will only be briefly described here.

Where a gown (100) was included in a patient warming system (600), the packaging of the patient warming system (600) can be accessed and/or provided at step 1601. Where the warming device (601) includes rechargeable batteries, they can be charged at step 1602.

At step 1603, the gown (100) is applied to a patient. At step 1604, the warming device (601) can be placed in a pocket (112) of the gown (100). In one embodiment, the pocket (112) comprises an outer layer (111) comprising a film layer (116) having a thermally reflective side disposed along an interior of the pocket (112). Where the warming device (601) includes a power supply (603) coupled to a warming portion (602) by a power cord (604), optional step 1105 can include placing the power supply (603) of the warming device (601) in a second pocket (660). The user can optionally control the amount of heat being delivered by the warming device (601) at step 1606. Where the gown (100) is disposable, it can be disposed at step 1607. Alternatively, if reusable, the gown (100) can be laundered and sterilized at step 1608.

In accordance with the description above, embodiments of the invention provide a gown that employs a patient-controllable, battery-operated heating element that is disposed in a pocket. Using available technology such as that set forth above, a warming device can be configured with a flexible heating element that is housed in a durable, cleanable impervious cover, one example of which comprises a durable material made by Dartex Coatings of Rhode Island. The pocket can be configured with a narrower base, examples of which include T-shapes and inverted trapezoids. The pocket can include a reflective fabric that reflects heat from the warming device back toward the patient. The gown can optionally include a second pocket to conveniently secure any attached battery or power supply and control unit, thus making the gown completely mobile. In a hospital setting, each patient can receive a new disposable gown with a reusable warming device placed in the pocket. The warming device can be secured in the pocket by a closure, which can be a hook and loop fastener or other suitable closure device. The warming device and pocket can also be designed to wrap around the back of the gown to provide heating in the highly vascular kidney area. Embodiments of the invention can be used by patients for pre-op comfort and pre-warming and can be placed back on the patient for comfort or additional clinical warming if needed. After use, the gown can be discarded, while the warming device is cleaned. The battery of the warming device can then be charged use with another patient and another gown.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A gown, comprising:

a body-covering portion; and an outer layer coupled to the body-covering portion, thereby defining a pocket, wherein the outer layer comprises a film layer having a thermally reflective side disposed facing the body-covering portion;

the pocket disposed along a chest covering portion of the body-covering portion;

a base of the pocket extending about the body-covering portion and at least partially covers a kidney-covering portion of the body-covering portion.

2. The gown of claim 1, wherein the outer layer further comprises non-woven fibers needle-punched through the film layer.

3. The gown of claim 2, wherein a side of the pocket nearest a neck opening of the gown defines an opening.

4. The gown of claim 3, further comprising a closure disposed at the opening configured to selectively close the pocket.

5. The gown of claim 4, wherein the closure comprises a hook and loop fastener.

6. The gown of claim 2, wherein the film layer comprises a polyester film.

7. The gown of claim 6, wherein the polyester film comprises polyethelyene terepthalate.

8. The gown of claim 2, wherein the non-woven fibers are needle punched distally through the thermally reflective side.

9. The gown of claim 2, wherein the pocket is T-shaped, with a top of a T-shape oriented toward a neck opening of the gown.

10. The gown of claim 2, wherein the pocket is inverse trapezoidal in shape, with a base of a trapezoid oriented toward a neck opening of the gown.

11. The gown of claim 1, wherein the film layer comprises a metalized layer.

12. The gown of claim 1, wherein the gown is disposable.

13. The gown of claim 1, wherein the body-covering portion comprises a non-woven fabric layer.

14. A patient warming system, comprising:

a gown having a body covering portion and an outer layer coupled to the body covering portion, thereby defining a pocket; and a warming device;

the pocket configured to receive the warming device; and one of the warming device or the outer layer comprising a film layer having a thermally reflective side;

the pocket disposed at least on a chest portion of the gown;

the gown defining a rear opening comprising a slit running along a portion of a rear of the gown.

15. The patient warming system of claim 14, wherein the warming device comprises rechargeable batteries.

16. The patient warming system of claim 15, further comprising a charger configured to charge the rechargeable batteries.

17. The patient warming system of claim 16, wherein:

the warming device comprises a warming portion, a power supply, and a power cord coupling warming portion to the power supply; and the gown comprises a second pocket configured to receive the power supply.

18. A method of warming a patient, comprising:

placing a gown comprising a pocket defined by an outer layer comprising a film layer having a thermally reflective side disposed along an interior of the pocket on the patient;

the pocket disposed along a chest covering portion of the outer layer, with a base of the pocket extending about the outer layer to at least partially cover a kidney-covering portion of the outer layer; and placing a warming device in the pocket.

19. The method of claim 18, further comprising placing a power supply of the warming device in a second pocket.

* * * * *